US005711398A

United States Patent [19]

Bartholomew

[11] Patent Number: 5,711,398

[45] Date of Patent: Jan. 27, 1998

[54] SAFETY RAIL SYSTEM FOR USE DURING CONSTRUCTION OR MAINTENANCE REPAIR OF PITCHED ROOFS

[76] Inventor: Paul F. Bartholomew, 10312 Baileywick Rd., Raleigh, N.C. 27613

[21] Appl. No.: 562,654

[22] Filed: Nov. 27, 1995

[51] Int. Cl.[6] ..... E04G 3/12

[52] U.S. Cl. ..... 182/45; 248/237; 256/59; 256/DIG. 6; 52/27

[58] Field of Search ..... 256/59, DIG. 6, 256/65; 248/237, 231.41, 228.1, 228.3; 182/45; 52/27

[56] References Cited

U.S. PATENT DOCUMENTS

| | | | |
|---|---|---|---|
| 1,926,207 | 9/1933 | MacAlpine . | |
| 2,329,415 | 9/1943 | Osborne | 182/45 |
| 2,426,825 | 9/1947 | Geary . | |
| 3,880,405 | 4/1975 | Brueske . | |
| 3,901,481 | 8/1975 | Probst . | |
| 4,132,287 | 1/1979 | Parolini . | |
| 4,226,058 | 10/1980 | Riley | 248/237 |
| 4,398,620 | 8/1983 | Townsend . | |
| 4,666,131 | 5/1987 | Kettelkamp, Sr. et al. | 256/59 |
| 4,676,341 | 6/1987 | Shaffstall . | |
| 4,957,185 | 9/1990 | Courchesne . | |
| 4,979,725 | 12/1990 | Hutchings, II . | |
| 5,067,586 | 11/1991 | Myers . | |
| 5,143,171 | 9/1992 | Glynn . | |
| 5,148,890 | 9/1992 | Sipe . | |
| 5,221,076 | 6/1993 | Zost . | |
| 5,307,897 | 5/1994 | Turner . | |
| 5,331,776 | 7/1994 | Shelton . | |
| 5,353,891 | 10/1994 | Griek . | |
| 5,379,859 | 1/1995 | Pigman . | |
| 5,515,941 | 5/1996 | Palmer et al. | 182/45 |

FOREIGN PATENT DOCUMENTS

| | | | |
|---|---|---|---|
| 2392-198 | 1/1979 | France | 182/45 |
| 526979 | 8/1927 | Germany | 182/45 |
| 2448136 | 10/1974 | Germany | 182/45 |
| 49112 | 12/1991 | Germany | 182/45 |
| 2192660 | 1/1988 | United Kingdom | 182/45 |
| 2208889 | 4/1989 | United Kingdom | 182/45 |
| 48905 | 5/1989 | United Kingdom | 182/45 |
| 2243397 | 10/1991 | United Kingdom | 182/45 |

*Primary Examiner*—Leslie A. Braun
*Assistant Examiner*—Donald J. Wallace
*Attorney, Agent, or Firm*—Jones & Volentine, L.L.P.

[57] ABSTRACT

A safety rail system is provided at the edge of a pitched roof under construction or undergoing repair maintenance to afford protection against a roof worker falling off the roof. The system includes multiple, spaced apart rail support assemblies, each of which resides over a respective joist and provides means for receiving and supporting end-lapped safety planks. Each support assembly is detachably secured in place by a J-hook structure that is inserted into the gap between adjacent courses of roof sheet overlay and lockingly engages the underlying joist.

9 Claims, 7 Drawing Sheets

SAFETY RAIL SYSTEM FOR USE DURING CONSTRUCTION OR MAINTENANCE REPAIR OF PITCHED ROOFS

FIELD OF INVENTION

The invention relates to the protection of workers at construction sites. More particularly, the invention relates to a safety rail system located near the lower edge of a pitched roof under construction or maintenance repair that serves as a barrier to prevent a worker who has lost his footing from accidentally falling off the edge of the roof.

BACKGROUND OF THE INVENTION

Workers involved in the construction or maintenance repair (e.g. re-roofing) of pitched roofs risk serious injury if they should lose their footing and fall off the edge of the roof. Various safety systems have been proposed over the years, and now government regulations mandate a suitable safety rail or other safety device at the roof edge.

The most common form of pitched roof construction, and the one to which the present invention has primary utility, is a wood roof system including inclined, spaced apart, parallel joists (typically two feet on center) over which is secured a plywood roof overlay. One early attempt at providing a safety structure at the roof edge was for the workers to attach a 2×4 nailed-down toe board at the very edge of the roof after the first course of plywood had been laid. The toe board provided very little protection for a worker who was sliding or tumbling toward the roof edge.

Other attempts have involved tying off workers to a rope or cable that is anchored to a suitable support. In the use of these tie-off systems, the worker usually wears a belt or harness that is connected to the rope. The disadvantages associated with tie-off systems are well-known. First, it is usually difficult to find a suitable anchor point to anchor the rope to, one that will withstand several thousand pounds of force in several directions as required by OSHA regulations. Second, when a crew of men who are tied to ropes are all trying to walk around and lay plywood roofing sheets, the tie-off system becomes more of a hazard than a safety measure.

Another commonly used safety system is a scaffold buck system that is built from the ground up to the edge of the roof, with a platform and safety rail system provided on the scaffold bucks next to the edge of the roof. These systems provide suitable safety protection, but are known to be costly in terms of materials and the time necessary to set them up and take them down.

More recently, roof safety barriers have been proposed having a frame assembly that attaches near the edge of the roof. These barriers, as described, for example, in U.S. Pat. Nos. 3,901,481; 4,666,131; 4,979,725; and 5,067,586, typically include horizontally disposed wooden planks supported at the roof edge by a series of spaced apart, upstanding stanchions. These systems have the common disadvantage of complexity in both structure and operation, particularly with respect to securement to the roof and later detachment from the roof upon completion of roof construction.

Thus, there is an acute need for a reliable and dependable safety system for pitched roofs that meets OSHA requirements and is simple to manufacture, install and use.

SUMMARY OF THE INVENTION

The present invention provides a novel and versatile roof safety barrier system that achieves the above-mentioned goals and can be installed and removed without the need to modify the roof structure in any way. In one aspect, the invention may be defined as a rail support assembly including an upstanding stanchion carrying means for receiving and supporting end-lapped safety planks. An elongate base is joined to said stanchion with the base being adapted to overlie one of the roof joists so as to be oriented substantially perpendicular to the roof edge. The base has a first end that is operatively oriented remote from the roof edge and a second end operatively oriented closer to the roof edge, with the stanchion being joined to the elongate base at a location spaced from the base second end. The rail support assembly further includes a securement assembly located at the first end of the elongate base detachably securing the rail support assembly to the roof. The securement assembly includes means operatively residing in the gap between two courses of sheet overlay near the roof edge for (i) lockingly engaging the elongate base to its respective underlying joist and for (ii) disengaging the joist upon completion of roof construction to permit removal of the rail support assembly.

The securement means residing in the gap between the two courses of sheet overlay preferably includes a J-hook having an upper end, a main body portion and a bottom portion. This J-hook is pivotally secured at its upper end to the first end of the elongate base abut a horizontal pivoting axis. The J-hook resides in the gap between two courses of sheet overlay near the roof edge with the J-hook bottom portion in locking engagement with the underside of the respective joist.

In another aspect, the invention may be defined as a procedure for erecting and thereafter removing a temporary barrier at the edge of a roof under construction utilizing multiple aligned rail support assemblies that attach to the roof by engagement to underlying joists utilizing a securement assembly that can be inserted into and removed form the gap formed between adjacent courses of sheet overlay near the roof edge.

BRIEF DESCRIPTION OF THE DRAWINGS

Some of the objects having been stated, other objects will appear as the description proceeds, when taken in connection with the accompanying drawings, in which—

DETAILED DESCRIPTION OF THE INVENTION

While the present invention will be described more fully hereinafter with reference to the accompanying drawings, in which aspects of the preferred manner of practicing the present invention are shown, it is to be understood at the outset of the description which follows that persons of skill in the appropriate arts may modify the invention herein described while still achieving the favorable results of this invention. Accordingly, the description which follows is to be understood as being a broad, teaching disclosure directed to persons of skill in the appropriate arts, and not as limiting upon the present invention.

Figure 1:
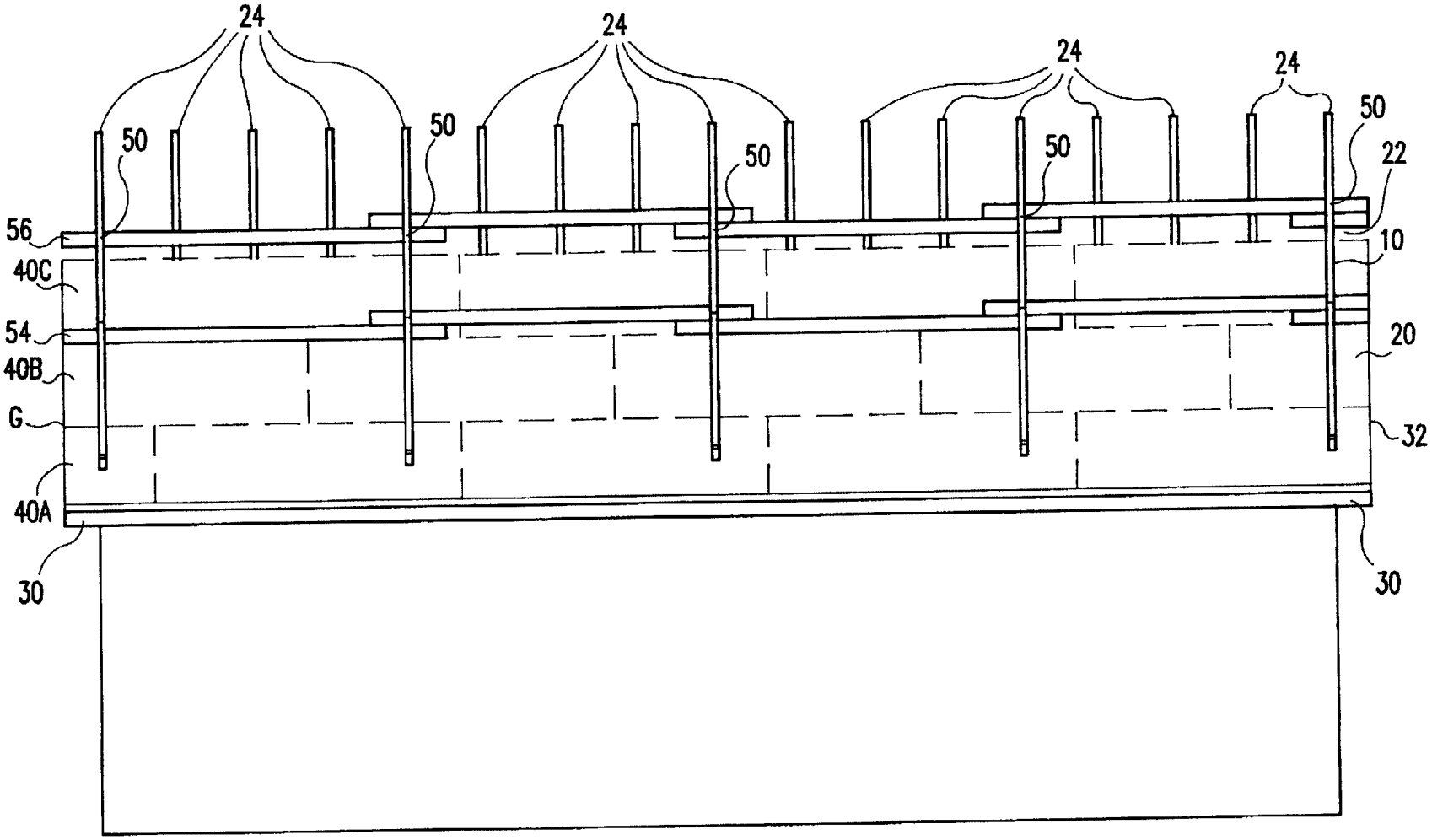
FIG. 1 is a side view of a building with a pitched roof under construction and showing a safety rail system of the present invention installed near the edge of the roof.

Referring to the drawings, and particularly to FIG. 1, there is shown a safety rail system 10 constructed in accordance with the present invention in place on a conventional pitched roof 20 that is under construction. Pitched roof 20 includes a truss structure 22 formed by inclined, generally parallel, spaced apart joists 24 that run generally perpendicular to the roof edge 30, and a plywood overlay 32 on the joists that are formed by successive courses 40A, 40B, 40C . . . of sheet overlay such as plywood sheets, OSB sheets, or equivalent. The first course 40A begins adjacent roof edge 30, while the successive courses 40B, 40C . . . progress upwardly toward the apex (not shown) of the roof. According to generally accepted construction practices, a gap G (dashed lines) is provided between the overlay sheets of the successive courses with the recommended gap being on the order of ⅛".

Figure 2:
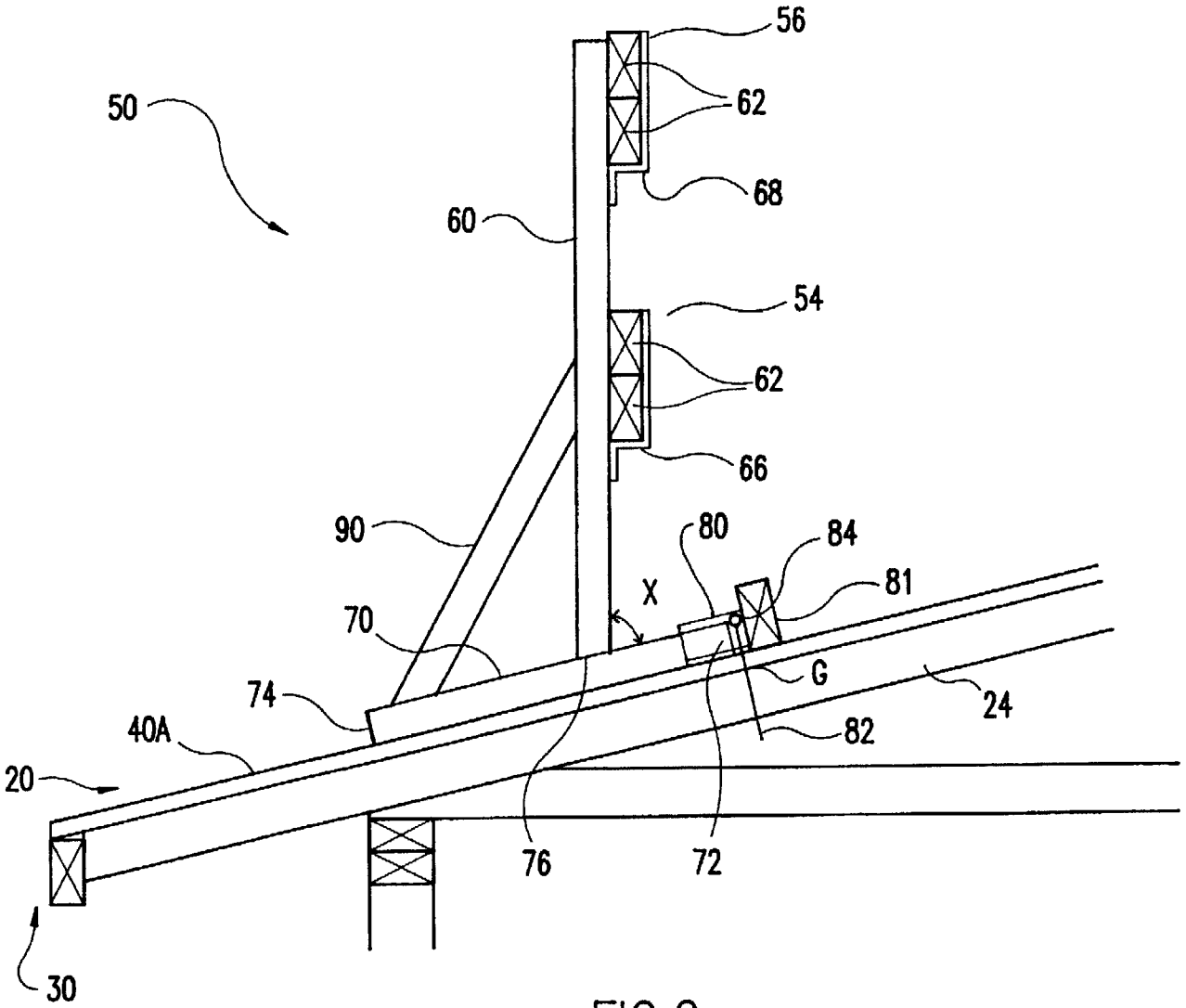
FIG. 2 is a side view, partly in section, of one of the rail support assemblies of the invention installed above one of the joists of a pitched roof under construction.

Safety rail system 10 includes multiple (five shown) rail support assemblies 50 that are spaced apart along the roof edge and supported above one of the first courses of overlay sheets, preferably above the first course 40A. The purpose of the multiple rail support assemblies is to provide a trustworthy support for the two continuous safety rails 54 and 56 that are at heights of approximately 21" and 42" above the roof surface, as mandated by OSHA regulations. With primary reference to FIG. 2, each rail support assembly 50 includes an upstanding stanchion 60 that carries means for receiving and supporting end-lapped wooden planks 62 that together form the continuous safety rails 54, 56. The stanchion may take any convenient rigid form, and in one embodiment is formed from 1½" tubular steel stock. In the illustrated embodiment, the means for receiving and supporting the end-lapped planks comprises ¼" by 1½" strap steel material bent to an L-configuration sufficient to hold two 2×4 planks 62, with a first L-support 66 being at approximately 21" from the bottom of stanchion 60 and a second L-support 68 being at a height of approximately 42" from the bottom of the stanchion.

Each rail support assembly 50 further includes an elongate base 70 that is joined to the bottom of stanchion 60 and is adapted to directly overlie one of the joists 24 (with intervening overlay sheet) so as to be oriented substantially perpendicular to roof edge 30. Elongate base 70 may be formed from the same 1½" tubular steel stock as the stanchion. Elongate base 70 includes a first end 72 that, in operation, is positioned remote from the roof edge and a second end 74 that is closer to the roof edge. In the illustrated embodiment, stanchion 60 joins elongate base 70 at a location 76 that is spaced from the base second end 74, preferably at a substantially central location along base 70, for example, within the central two-thirds of base 70.

Figure 6:
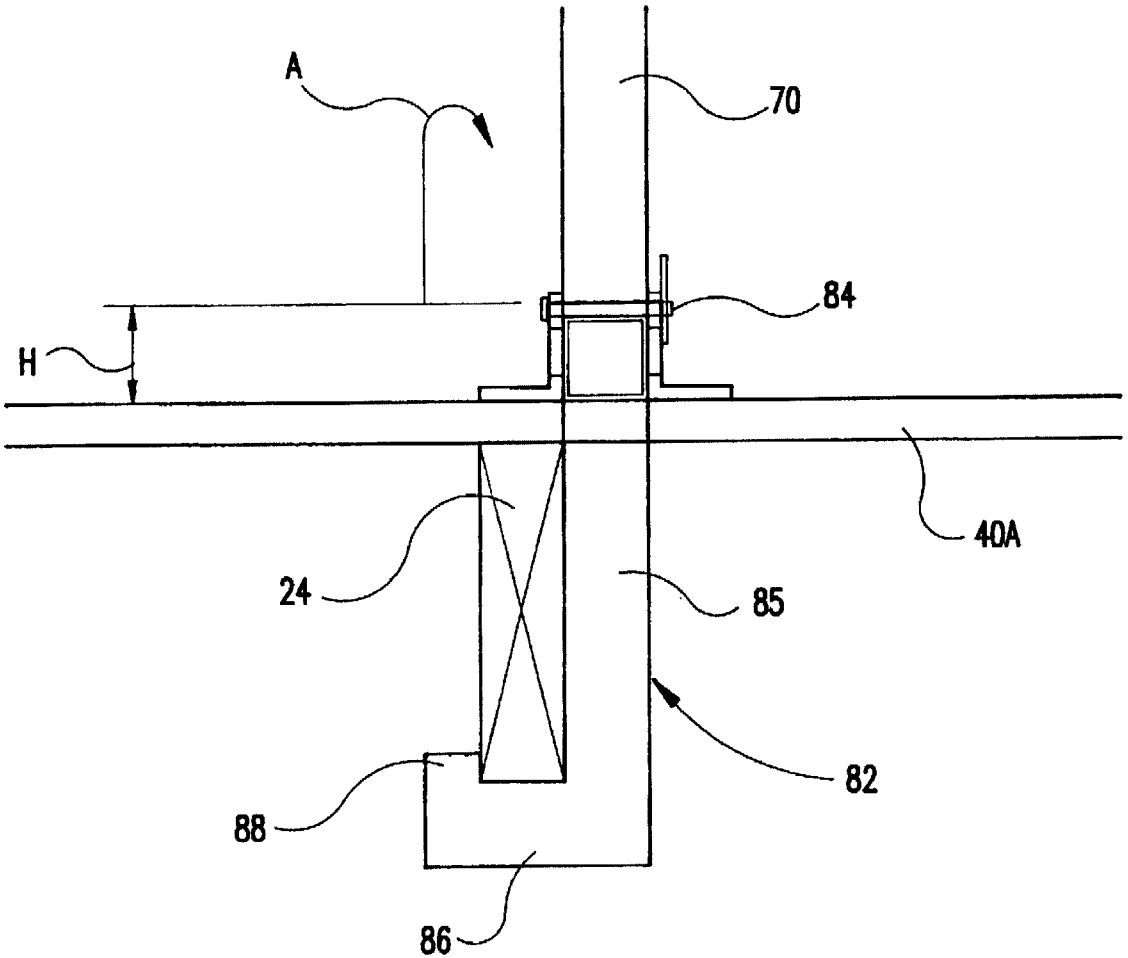

Rail support assembly 50 further includes a securement assembly 80 located at the front end 72 of elongate base 70. The purpose of securement assembly 80 is to detachably secure the rail support assembly to the roof. In the illustrated embodiment, securement assembly 80 takes the form of a thin, flat J-hook 82 that is pivotally connected to elongate base 70 by a hinge 84 that is located at a height H(FIG. 6) above the lower surface of elongate base 70. The hinge may be coplanar with the top surface of elongate base 70, as illustrated. J-hook 82 includes a top portion, a main body portion 85, a bottom portion 86 and an upstanding tip portion 88, with the entire J-hook preferably being integrally formed of a single sheet of metal having a thickness that permits it to be inserted and removed through the standard ⅛" gap between courses of plywood overlay.

Figure 3:
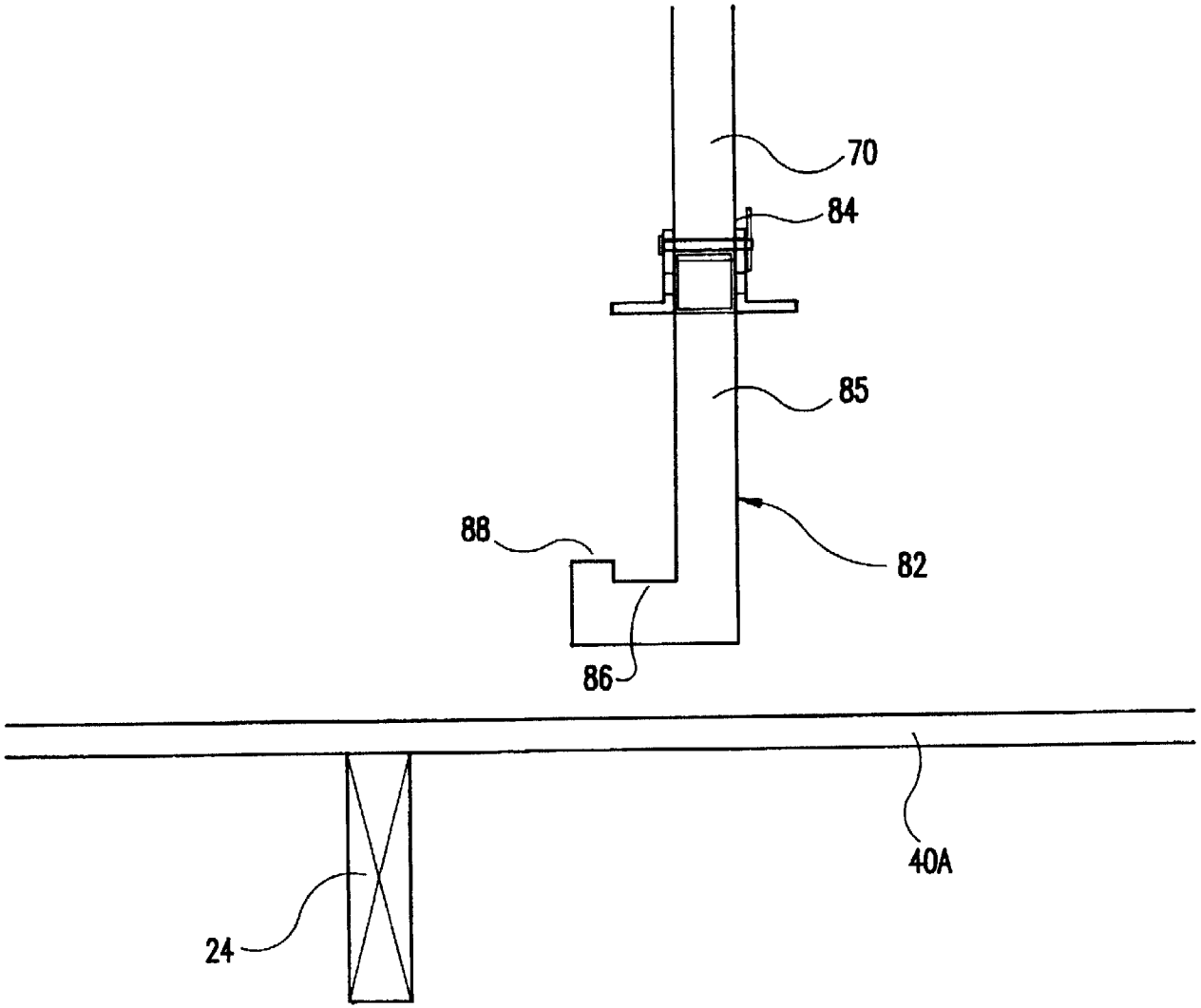
FIGS. 3–6 are enlarged views showing the successive steps for lockingly engaging one of the rail support assemblies to a joist.
Figure 4:
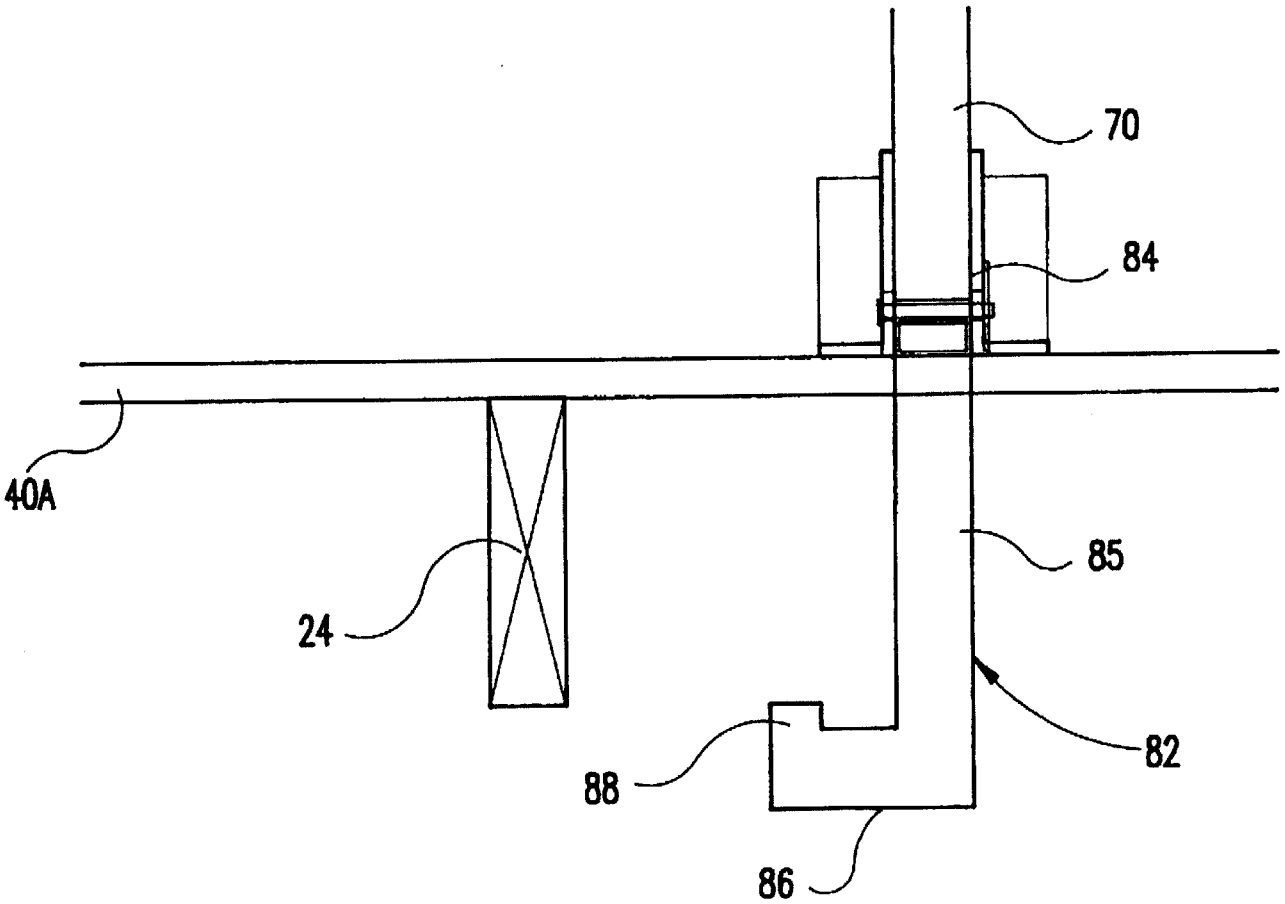
Figure 5:
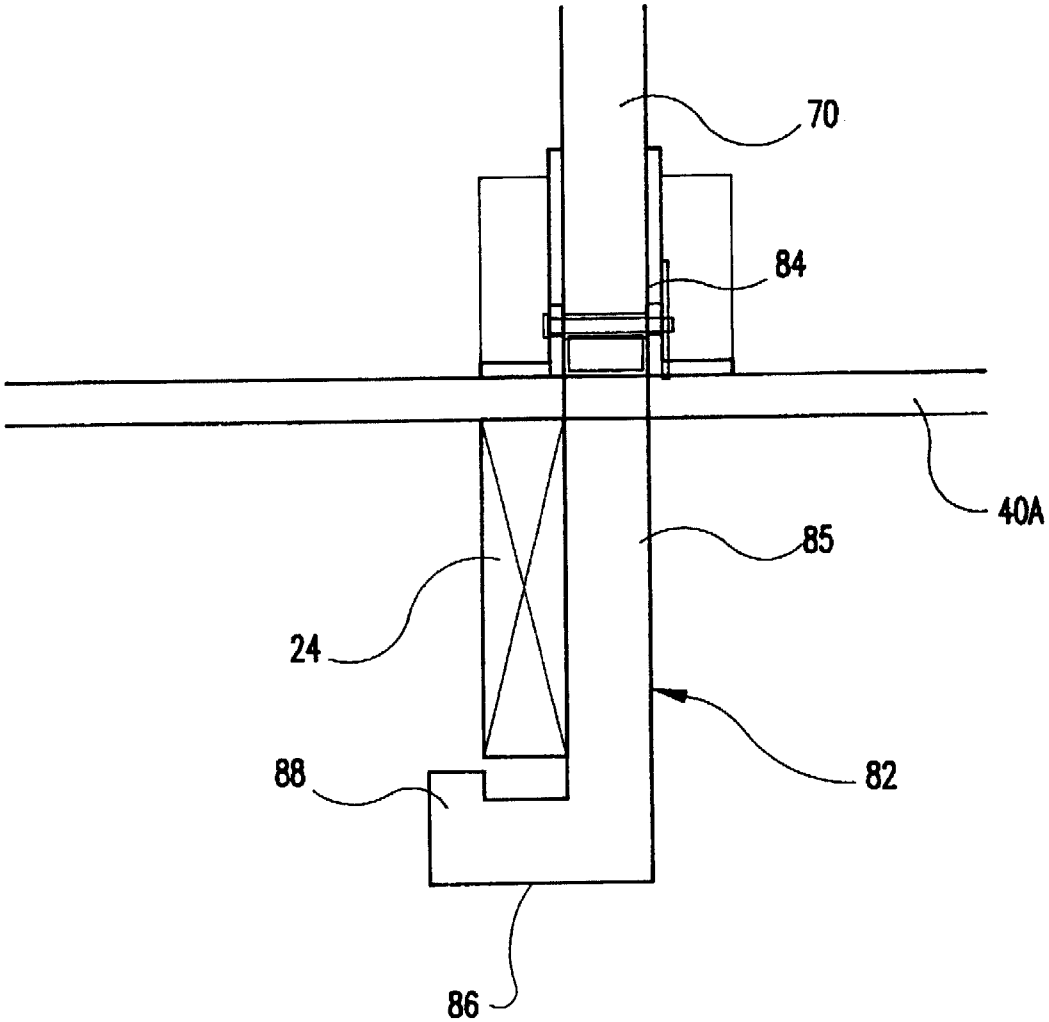
Figure 6A:
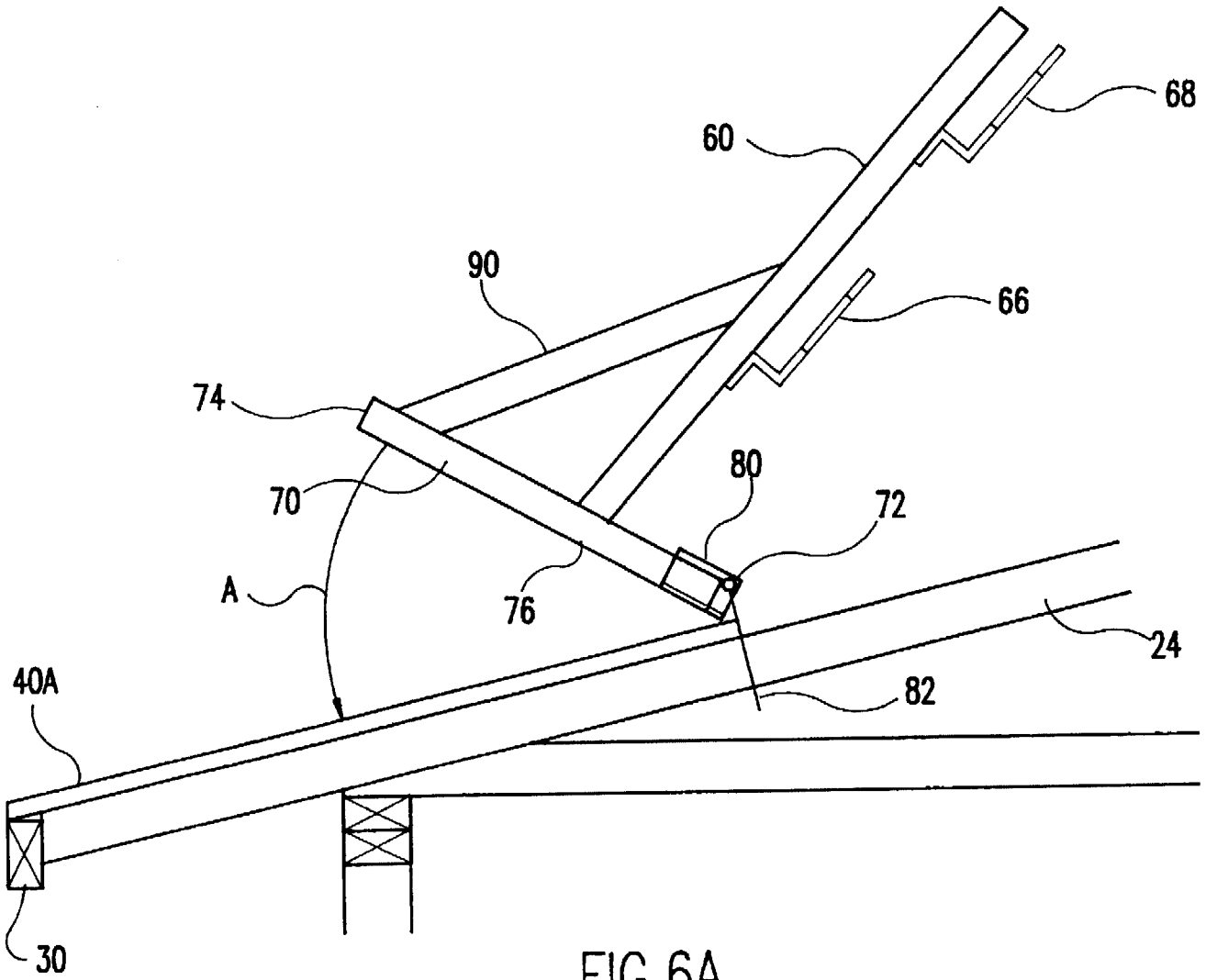
FIG. 6A is a side view similar to FIG. 2 but showing the rail support assembly as it is being pivoted from the position it occupies during the performance of the installation steps of FIGS. 3, 4 and 5 to the fully installed position of FIG. 6.

Referring now to FIGS. 3–6, the procedure for installing a rail support assembly during roof construction will be described. Before installation, the roof trusses must be properly positioned and braced following procedure HIB-91 that is well known in the art. The first course of sheet overlay, e.g., 4x8 plywood sheets, is nailed to the joists of the truss system and this first course is preferably dried in. Next, as the first step in detachably securing rail support assembly 50 to the roof system elongate base 70 is raised to a near vertical position as shown in FIG. 3 so that J-hook 82 is substantially collinear with base 70. In this orientation, and with J-hook 82 positioned just above the upper edge of the first course 40A of plywood overlay and slightly laterally offset from joist 24, J-hook 82 is then lowered (FIG. 4) so that the upstanding tip 88 is positioned at a level just below the bottom of joist 24 when hinge 84 rests on top of the overlay sheet. Next (FIG. 5), the J-hook 82 is shifted laterally to place the J-hook bottom portion 86 directly under joist 24. In order to lock the J-hook to the joist, in the next step (FIGS. 6 and 6A) the elongate base 70 is lowered by a pivoting action (arrow A) around base first end 72 to bring the entire elongate base 70 into overlying contact with the plywood directly above joist 24. So lowering elongate base 70 serves to raise hinge 84 to a level above the overlay sheet and thereby raise J-hook bottom portion 86 into contact with the bottom of joist 24, while permitting J-hook tip 88 and main body portion 85 to engage the respective sides of joist 24. When elongate base 70 is fully lowered, J-hook 82 lockingly engages to joist 24 on three sides and securely holds rail support assembly 50 in the illustrated position. It will be appreciated that forces of gravity, coupled with the locking action of J-hook 82, hold assembly 50 in the operative upright orientation shown in FIGS. 1 and 2. Disengagement of J-hook 82 from joist 24 due to lateral forces is effectively prevented by the engagement of the sides of the joist by tip 88 and main body portion 85 After all of the rail supports 50 have been installed, the second course 40B of overlay sheets is applied with a sufficient gap to accommodate the J-hooks and to permit the J-hooks to slide out later when it is time to remove the safety system. A toe board 81 (FIG. 2) may be applied adjacent the gap G between courses 40A and 40B.

Upon completion of roof construction or maintenance repair, the J-hook can be removed by reversing the above steps and sliding the hook out through the gap G between plywood overlay courses 40A and 40B. Thus, J-hook 82 and its associated structure provide a securement assembly that (i) lockingly engages the elongate base to its respective underlying joist and (ii) permits disengagement from the joist upon completion of roof construction to permit removal of the rail support assembly, all without any necessary modification to the roof structure.

The safety rail system 10 is completed by placing planks 62 in an end-lapped fashion into the respective L-supports 66 and 68, as shown in FIG. 1.

In the illustrated embodiment, rail support assembly 50 further includes a brace 90 secured to stanchion 60 and to elongate base 70 at or near the base second end 74. While brace 90 may be deemed an optional feature of the invention, the use of the brace helps to provide adequate strength for the overall structure with less overall weight. The brace also provides assembly 50 with protection from abuse, such as dropping the assembly from the roof to the ground. Brace 90 may be formed from the same 1½" tubular steel stock as stanchion 60 and elongate base 70.

It will be appreciated that the rail support assemblies may be spaced apart at any convenient distance according to need. Most preferably the support assemblies are spaced apart a maximum of 8 feet on center for a 4/12 pitched roof, 6 feet on center for an 8/12 pitched roof and 4 feet on center for a 12/12 pitched roof.

While the inventor does not intend to be limited by particular dimensions, in use with a typical roof system having 2×6 joists and 5/8" thickness plywood overlay, the dimensions of the J-hook are 1/8" thick, 9" tall, 3½" wide at the base and the interior pocket between tip 88 and main body portion 85 is 1 9/16". Additionally, stanchion 60 is 3 feet 6 inches high, elongate base 70 is 24 inches long, with stanchion 60 being secured to brace 90 at 8 inches from the base first end 72. Brace 90 is secured to elongate base 70 near the base second end 74 and to stanchion 60 at approximately one-half the height of the stanchion.

In the illustrated embodiment, stanchion 60 is rigidly joined to elongate base 70 at an angle X (FIG. 2) on the order of 70°. This angle results in stanchion 60 being exactly vertically oriented when used on a roof with a pitch of 20°. On roofs with greater or lesser pitches, stanchion 60 will be off vertical accordingly. Assembly 50, with angle X at 70°, serves well for roofs having a pitch from about 0° to 60° since it is not critical that the stanchion be exactly vertical.

The present invention has thus far been described as used in conjunction with a roof system having 2×6 joists. For 2×4, 2×8 or other joist sizes, the size of the J-hooks may be modified, primarily by adjusting the length of the J-hooks. As a less preferred option, fur-up strips as known in the art may be used to fur up the elongate bases 70 above the overlay sheets so that the J-hooks properly engage the underside of the joists.

It will be appreciated that the locking action of J-hook 82 to the underside of the joist may be enhanced by incorporating barbs into the J-hook bottom portion. With such a modification, or even without the barbs if the locking force exacted by the J-hook bottom portion is sufficient, the J-hook upstanding tip 88 may prove unnecessary. However, as currently contemplated, the three-sided engagement of the joist provided by tip 88 is deemed desirable.

As mentioned above, the present invention has utility not only in roof construction, but also in repair maintenance operations such as re-roofing a shingled roof. In such a re-roofing operation, a preferred manner of carrying out the invention is for the re-roofer to first remove the shingles from the roof edge upwardly until the gap G between the first and second courses 40A, 40B of sheet overlay is exposed, and then installing the multiple rail support assemblies and end-lapped safety planks in the manner described above.

While the invention has been described in connection with certain illustrated embodiments, it will be appreciated that modifications may be made without. departing from the true spirit and scope of the invention.

That which is claimed is:

1. In combination with a pitched roof under construction or maintenance repair, the pitched roof having a roof edge, a truss structure formed by inclined, generally parallel spaced apart joists running generally perpendicular to the roof edge and a sheet overlay on said joists defining gaps between the courses of sheets forming the overlay, a safety rail system located near the edge of the roof to serve as a barrier to prevent a roof worker who has lost his footing from falling off the edge of the roof, said safety rail system comprising:

multiple rail support assemblies spaced apart along the roof edge, each rail support assembly including:

an upstanding stanchion carrying means for receiving and supporting end-lapped safety planks;

an elongate base joined to said stanchion and overlying one of said joists so as to be oriented substantially perpendicular to said roof edge, said base having a first end remote from said roof edge and a second end closer to said roof edge, said stanchion being joined to said elongate base at a location spaced from said base second end;

a securement assembly located at the first end of said elongate base detachably securing the rail support assembly to the roof, said securement assembly comprising means residing in the gap between two courses of sheet overlay near the roof edge for (i) lockingly engaging the elongate base to its respective underlying joist and for (ii) disengaging the joist upon completion of roof construction or maintenance repair to permit removal of the rail support assembly, wherein said means residing in the gap between two courses of sheet overlay comprises a thin-flat J-hook having an upper end, a main body portion and a bottom portion, said J-hook being pivotally secured by a hinge at its upper end to the first end of said elongate base about a horizontal pivoting axis and said J-hook residing in the gap between the two courses of plywood overlay near the roof edge with the J-hook bottom portion in locking engagement with the underside of the respective joist, wherein said J-hook includes an upstanding tip portion in engagement with the side of the joist opposite the main body portion of the J-hook to provide three-sided engagement of the J-hook to the joist, whereby rotation of the support assembly about the horizontal pivoting axis causes said bottom portion to come into locking engagement with the joist, and end-lapped safety planks supported in the respective means carried by each stanchion to define continuous safety rails at a selected height or heights near the roof edge.

2. The combination of claim 1 wherein said J-hook bottom portion includes upstanding barbs to enhance the locking engagement with the underside of the joist.

3. The combination of claim 1 wherein said means on each stanchion for receiving and supporting end-lapped safety planks comprises a first means at a height on the order of 21" above the elongate base and a second means at a height on the order of 42" above the elongate base.

4. The combination of claim 1 wherein each rail support assembly includes a brace secured to the stanchion and to the elongate base at or near the base second end.

5. A rail support assembly for use in spaced apart relationship with other such assemblies near the edge of a pitched roof under construction or undergoing maintenance repair to support horizontally disposed, end-lapped safety planks that serve as a barrier to prevent a roof worker from failing of the edge of a roof, and wherein the pitched roof is of the type having a roof edge, a truss structure formed by inclined, generally parallel spaced apart joists running generally perpendicular to the roof edge and a sheet overlay on said joists defining gaps between the courses of sheets forming the overlay, said rail support assembly comprising:

an upstanding stanchion carrying means for receiving and supporting end-lapped safety planks;

an elongate base joined to said stanchion, said base being adapted to overlie one of said joists so as to be oriented substantially perpendicular to said roof edge with said base adapted to have a first end that is operatively oriented remote from said roof edge and a second end operatively oriented closer to said roof edge, said stanchion being joined to said elongate base at a location spaced from said base second end; and a securement assembly located at the first end of said elongate base adapted to detachably secure the rail support assembly to the roof, said securement assembly comprising means adapted to reside operatively in the gap between two courses of sheet overlay near the roof edge for (i) lockingly engaging the elongate base to its respective underlying joist and for (ii) disengaging the joist upon completion of roof construction to permit removal of the rail support assembly, wherein said means adapted to operatively reside in the gap between two courses of sheet overlay comprises a thin, flat J-hook having an upper end, a main body portion and a bottom portion, said J-hook being pivotally secured by a hinge at its upper end to the first end of said elongate base about an operatively oriented horizontal pivoting axis and said J-hook is adapted to reside in the gap between the two courses of sheet overlay near the roof edge with the J-hook bottom portion in locking engagement with the underside of the respective joist, wherein said J-hook includes an upstanding tip portion adapted to engage with the side of the joist opposite the main body portion of the J-hook to provide three-sided engagement of the J-hook to the joist whereby rotation of the support assembly about the horizontal pivoting axis causes said locking engagement.

6. The rail support assembly of claim 5 wherein said J-hook bottom portion includes upstanding barbs to enhance the locking engagement with the underside of the joist.

7. The rail support assembly of claim 5 wherein said means on each stanchion for receiving and supporting end-lapped safety planks comprises a first means at a height on the order of 21" above the elongate base and a second means at a height on the order of 42" above the elongate base.

8. The rail support assembly of claim 5 including a brace secured to the stanchion and to the elongate base at or near the base second end.

9. In a roof having a truss structure composed of spaced apart joists running perpendicular to a roof edge and a sheet overlay on top of said joists defining small gaps between courses of sheets forming the overlay, a roof anchoring system, comprising:

a base support member contacting said overlay and having first and second ends; and a joist securement assembly pivotally secured with a hinge about a horizontal axis to said first end of said base support member, said joist securement assembly lockingly engaging and disengaging a respective underlying, joist through said small gaps, said securement assembly comprising a thin, flat J-hook having a main body portion, a bottom portion and a upstanding tip portion, said bottom portion in locking engagement with an underside of said joist and said main body portion and said upstanding tip portion in contact with respective sides of said joist, thereby providing three-sided engagement of the J-hook to the joist, whereby rotation of said base support member about said horizontal axis causes said bottom portion to come into locking engagement with said joist.

* * * * *